US007805890B2

(12) United States Patent
Esmond et al.

(10) Patent No.: US 7,805,890 B2
(45) Date of Patent: Oct. 5, 2010

(54) RAIN AND STORM WATER FILTRATION SYSTEMS

(75) Inventors: Steven E. Esmond, 3943 Irvine Blvd., No. 154, Irvine, CA (US) 92602; Larry Quinn, Santa Ana, CA (US); Robert K. Weir, 2390 Forest St., Denver, CO (US) 80207

(73) Assignees: Steven E. Esmond, Irvine, CA (US); Robert K. Weir, Denver, CO (US)

( * ) Notice: Subject to any disclaimer, the term of this patent is extended or adjusted under 35 U.S.C. 154(b) by 0 days.

(21) Appl. No.: 12/399,306

(22) Filed: Mar. 6, 2009

(65) Prior Publication Data

US 2009/0236273 A1 Sep. 24, 2009

Related U.S. Application Data

(63) Continuation of application No. 10/819,445, filed on Apr. 6, 2004, now Pat. No. 7,584,577.

(51) Int. Cl.
*E04D 13/00* (2006.01)
*E04D 13/08* (2006.01)

(52) U.S. Cl. ..... 52/12; 52/13; 52/16; 210/747; 210/266; 210/251

(58) Field of Classification Search ..... 52/12, 52/13, 16; 210/747, 266, 251, 130, 154, 210/162–163
See application file for complete search history.

(56) References Cited

U.S. PATENT DOCUMENTS 543,922 A * 8/1895 Buckley ..... 210/249
1,552,902 A 9/1925 Werner
2,090,997 A 8/1937 French
2,419,501 A 4/1947 Pinto
3,628,668 A 12/1971 Huppert
4,250,038 A * 2/1981 Dryden ..... 210/409
4,415,462 A 11/1983 Finch et al.
4,472,274 A 9/1984 Williams (Continued)

FOREIGN PATENT DOCUMENTS

DE 43 21 408 A1 1/1995

(Continued)

OTHER PUBLICATIONS 3 sheets of "Products" from www.hydroscreen.com describing Coanda-effect screens. Printed Apr. 6, 2004.

(Continued)

*Primary Examiner*—Richard E Chilcot, Jr.
*Assistant Examiner*—Mark R Wendell
(74) *Attorney, Agent, or Firm*—Klein, O'Neill & Singh, LLP

(57) ABSTRACT

A debris-filtering downspout and other water runoff conduits and receptacles are disclosed, and include a screen mounted within a conduit, a culvert, a storm water conveyance or secured to a water collection basin. The screen provides high water throughput and is self-cleaning while effectively filtering debris contained in an incoming water stream. Optionally, media pads may be included to further scrub the water before it exits the downspout assembly.

17 Claims, 9 Drawing Sheets

U.S. PATENT DOCUMENTS

| | | | | |
|---|---|---|---|---|
| 4,801,377 | A | 1/1989 | Bolt | |
| 5,354,467 | A | 10/1994 | Moorhead | |
| 5,405,539 | A | 4/1995 | Schneider | |
| 5,452,546 | A | 9/1995 | Goddard | |
| 5,709,051 | A | 1/1998 | Mazziotti | |
| 5,985,158 | A | 11/1999 | Tiderington | |
| 6,095,338 | A * | 8/2000 | Connolly et al. | 209/274 |
| 6,183,633 | B1 | 2/2001 | Phillips | |
| 6,190,545 | B1 | 2/2001 | Williamson | |
| 6,511,595 | B2 * | 1/2003 | Crompton et al. | 210/162 |
| 6,531,059 | B1 * | 3/2003 | Morris et al. | 210/164 |
| 2002/0175120 | A1 | 11/2002 | Norell et al. | |

FOREIGN PATENT DOCUMENTS

| | | |
|---|---|---|
| DE | 44 28 969 A1 | 2/1995 |

OTHER PUBLICATIONS 2 sheets from www.norrisscreen.com/applications. Printed Apr. 6, 2004.

Wahl, T., "Hydraulic Performance of Coanda-Effect Screens," Journal of Hydraulic Engineering, vol. 127, No. 6, pp. 1-16, Jun. 2001.

Office Action mailed Jun. 13, 2007 from Related U.S. Appl. No. 10/819,445, filed Apr. 6, 2004.

Office Action mailed Oct. 15. 2008 from Related U.S. Appl. No. 10/819,445, filed Apr. 6, 2004.

Final Office Action mailed Dec. 17, 2008 from Related U.S. Appl. No. 10/819,445, filed Apr. 6, 2004.

* cited by examiner

Detail B

Detail A

Section A-A

RAIN AND STORM WATER FILTRATION SYSTEMS

CROSS-REFERENCE TO RELATED APPLICATION

This application is a continuation of application Ser. No. 10/819,445, filed Apr. 6, 2004, now U.S. Pat. No. 7,584,577 the contents of which are expressly incorporated herein by reference.

The rain and storm water filtration systems discussed herein relate to filtration systems that employ screens to filter debris and other unwanted material from water streams and, more specifically, to filtration systems having a screen comprising a plurality of wedge wires or tilted wedge wires for filtering water streams.

BACKGROUND

Rainwater downspouts, curbside storm water runoff collectors, and similar water conduits share a common purpose: removal of water from where it is undesired, be it the roof of a building, a city street, a storm basin, or the like. All such conduits allow a volume of water to pass therethrough. Leaf litter, sand, dirt, grit, and other debris cam accumulate within such conduits and clog them, rendering them ineffective. Equally bad, the poor design of many water conduits allows debris to pass through to downstream channels and, ultimately, the ocean, with a consequent negative environmental impact.

Not surprisingly, much effort and money has been spent devising ways to avoid clogged water conduits and contaminated water streams. Patents have been granted for inventions designed to filter water at curbside storm drains (U.S. Pat. No. 6,231,758 to Morris et al.), to treat water in a horizontal passageway (U.S. Pat. No. 6,190,545 to Williamson), to create temporary stream filtration systems (U.S. Pat. No. 4,297,219 to Kirk et al.), to remove downspout debris (U.S. Pat. No. 5,985,158 to Tiderington), and to shield rain gutters on the eaves of a building (U.S. Pat. No. 4,345,925 to Jefferys).

However, with respect to downspouts and storm water systems, the prior art has several shortcomings. Among other things, it is difficult to devise a system that both operates under high flow and effectively filters out small particulate matter and other debris. This is because a filter element that accommodates large flow must also be designed with large spacing to suit the large flow. However, large spacing allows medium to small particulates and waste to pass through unfiltered. Conversely, a filter element designed to trap small particulate matter typically obstructs flow. An ideal water runoff filter would be both capable of passing high flow therethrough and removing small waste and debris.

Accordingly, there remains a need for a filter system for removing debris from a water stream using a filter element that is amenable to high volume flow, capable of removing or trapping waste the size of or even smaller than the size of the gap used for the filter and, preferably, self-cleaning.

SUMMARY

The present invention integrates a Coanda screen (sometimes called "Coanda-effect" screen) into water collection systems such as downspouts, storm runoff collectors, sewer drains, and similar conduits and receptacles. An exemplary embodiment includes retrofitting an existing downspout section (or customizing a new downspout section) with a Coanda screen to provide a downspout with a highly efficient filter for removing debris from a stream of water. Depending on the water flow rate and the size of the debris encountered, different screen sizes and different screen mounting angles may be selected to accommodate the same. Filtered water can pass through the screen, while debris is retained by the Coanda screen and then collected in an optional retaining basket.

In another embodiment, a curbside inlet to a storm drain is fitted with a Coanda screen. The screen is mounted between a raw inlet basin and an outlet basin. Filtered water is allowed to pass over the screen and then fall through the screen into the outlet basin, which then flows onward via an outlet pipe. Captured debris and waste are allowed to fall into a retention basin. To remove waste and debris more effectively, a retaining basket is used. When full, the basket can be lifted out of the curbside inlet and emptied.

In yet another embodiment, there is provided a downspout filter assembly comprising a housing comprising an inlet, and outlet, an interior cavity, and an entrance to the interior cavity; a filter comprising a plurality of wedge wires mounted in the interior cavity of the housing having a portion positioned directly subjacent the inlet; and at least one media pad positioned under the filter for scrubbing water before it exits the outlet.

The present invention may also be practiced by providing a downspout filter assembly comprising a housing comprising an inlet, and outlet, an interior cavity, and at least one surface positioned along a first plane; a Coanda filter positioned inside the interior cavity at an angle to the first plane; one or more media pads positioned in the interior cavity at a position below the Coanda filter.

In still yet another aspect of the present invention, there is provided a downspout filter assembly comprising a housing comprising an inlet, an outlet, and an interior cavity; a pair of rails attached to two sections of the interior cavity; at least one removable container positioned on the pair of rails; a media pad positioned in the at least one removable container or below the at least one removable container; and a filter comprising a plurality of wedge wires mounted in the interior cavity in a position above the media pad.

Yet in another aspect of the present invention, there is provided a downspout filter assembly comprising a housing comprising an inlet, and outlet, an interior cavity, and an entrance to the interior cavity; a filter comprising a plurality of wedge wires mounted in the interior cavity of the housing having a portion positioned subjacent the inlet; and at least one media pad positioned subjacent the filter for scrubbing water before it exits the outlet.

The present invention may also be practiced by incorporating a downspout filter assembly comprising a housing comprising an inlet, and outlet, an interior cavity, and at least one surface positioned along a first plane; a Coanda filter positioned inside the interior cavity at an angle to the first plane; at least one media pad positioned in the interior cavity at a position below the Coanda filter.

Yet, it is also within the spirit and scope of the present invention to incorporate a downspout filter assembly comprising a housing comprising an inlet, an outlet, and an interior cavity; a pair of rails attached to two sections of the interior cavity; at least one removable container positioned on the pair of rails; a media pad positioned in the at least one removable container or below the at least one removable container; and a filter comprising a plurality of wedge wires mounted in the interior cavity in a position above the media pad.

BRIEF DESCRIPTION OF THE DRAWINGS

These and other features of the invention will be better understood when considered in conjunction with the accompanying drawings, wherein like part numbers denote like or similar elements and features, and wherein.

DETAILED DESCRIPTION

Figure 1:
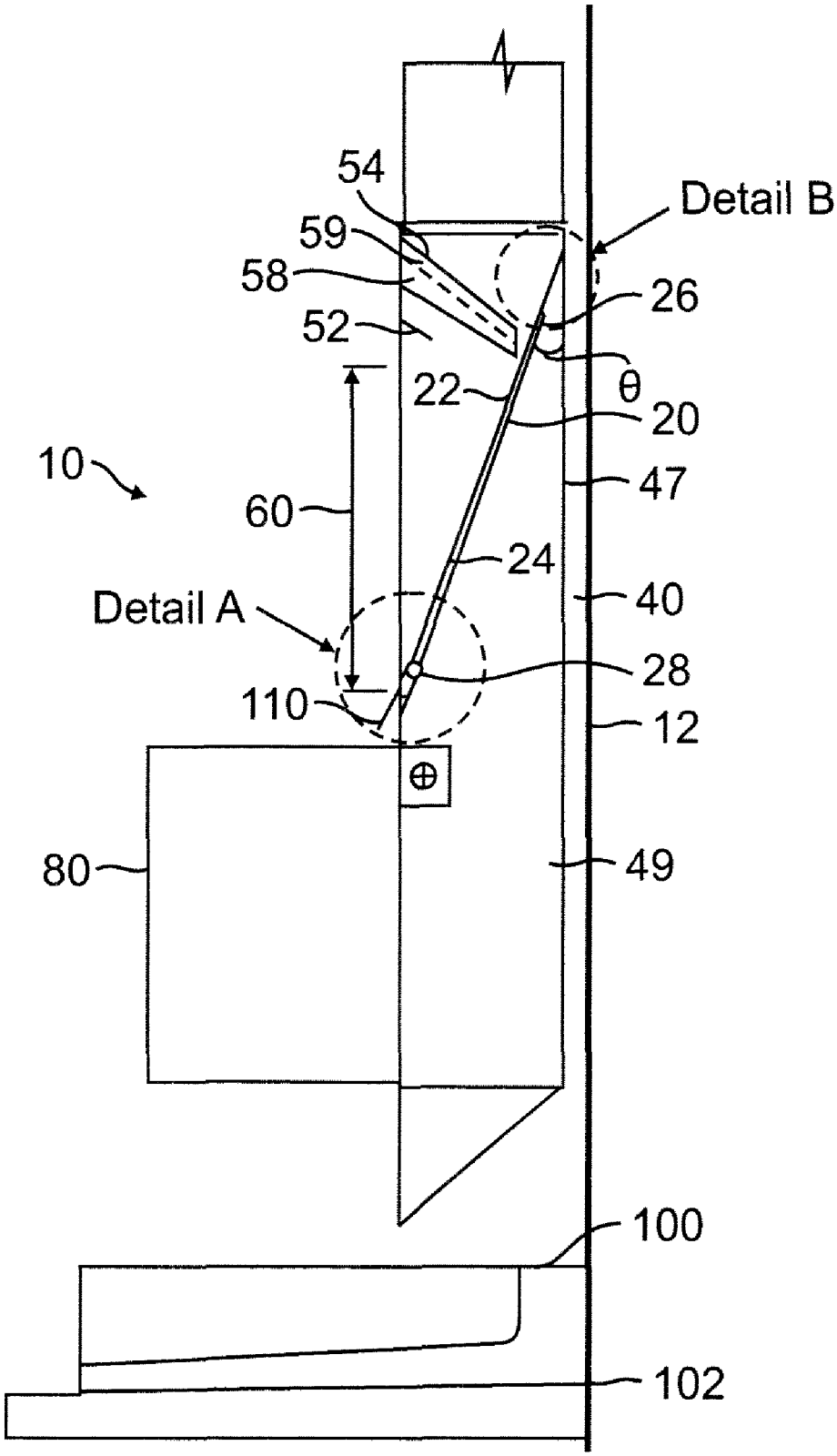
FIG. 1 is a side elevation view of a downspout with a Coanda screen in accordance with practice of the present invention.

In accordance with the present invention, a highly effective filter system for a rain water downspout, sewer inlet, curbside storm water drain, or similar water runoff conduit or receptacle is provided. A preferred embodiment of an improved downspout 10 is shown in FIG. 1. The downspout is mounted to an exterior wall 12 of a building by conventional mounting means (not shown), such as welds, adhesives (e.g., glue, cement, mortar, etc.), mechanical fasteners (e.g., rivets, bolts, screws, clamps, bands, straps. etc.). and other means known in the art. The downspout 10 includes a Coanda screen 20 mounted within a portion 40 of the downspout, referred to herein as an "upgraded downspout portion" or "upgraded downspout section". The screen is accessible via a downspout opening 60 in the upgraded downspout portion. Water that flows into the downspout from a gutter (not shown) is filtered as it passes through the Coanda screen. Debris caught by the screen can slide out of the downspout opening into an optional retaining basket 80 mounted outside of and below the downspout opening. Effluent from the downspout empties into a splash guard or basin 100 which, preferably, is seated on a concrete slab 102. Alternatively, the downstream end of the downspout is coupled to an underground header or a drain line (not shown) running to a main sewer or storm drain. The Coanda screen, upgraded downspout portion, retaining basket, and other features are described below in more detail.

An existing downspout can be upgraded or retrofitted by cutting out or otherwise removing a portion thereof, and installing an upgraded downspout portion or section 40 therein, using a slip joint, welds, adhesives, mechanical fasteners, or other conventional attachment means. Alternatively, an entire downspout can be fabricated as such and installed as part of a rain water removal system that includes one or more gutters and mounting hardware. In either case, the improved downspout provides a path for funneling water from a roof (or a deck, mezzanine, or other surface) to grade (e.g., street level) or to a storm water runoff drain or a main sewer line. Effluent from the downspout eventually flows to a storm drain or sewer system and then to the ocean, in some cases via a water treatment facility.

The downspout 10 is preferably constructed of stainless steel, galvanized steel, aluminum, plastic, or some other durable and water-resistant material, and has an interior and an exterior, and a cross-sectional shape that is generally rectangular. Alternatively, the downspout can have a generally circular cross-section or other desired geometry. In an exemplary embodiment, the downspout 10 is physically attached to an exterior wall 12 of a house or a building by any conventional means, such as downspout bands (not shown) anchored to the exterior wall. Water falling into the downspout passes into the upgraded downspout section 40 to the Coanda screen 20. The Coanda screen 20 allows water to pass through, but traps waste and debris behind.

A Coanda screen acts by a shearing action referred to as the "Coanda effect", which is discussed below in greater detail. In FIG. 1, the Coanda screen 20 has an upper surface 22, a lower or underside surface 24, a first (upstream) end 26, a second (downstream) end 28, and left and right sides, and is made of a plurality of wedge-shaped wires 30. Additional details of the wires=shape and relative orientation is provided below.

The Coanda screen 20 is mounted at an angle within the upgraded downspout portion 40, with the upstream end 26 of the screen elevated relative to the downstream end 28 of the screen. As shown in FIG. 1, the upgraded downspout portion 40 has four walls—front 46, back 47, left 48, and right 49 B and has substantially the same shape and dimensions as the remainder of the downspout. The Coanda screen is affixed within the upgraded downspout portion by e.g., securing the upstream end 26 of the screen to the back wall 47 of the upgraded downspout portion, and the downstream end 28 of the screen to the front wall 46 of the upgraded downspout portion. So installed, the screen is seen to form an angle θ (theta) with the back wall. In practice, it has been found that best results are achieved when θ has a value of about 15 to 50 degrees, more preferably, about 20 to 45 degrees.

Figure 2A:
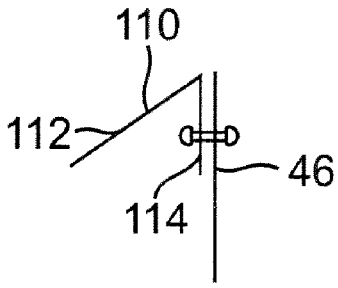
FIG. 2A is a partial cross-sectional view of a deflector plate.

To ensure that a substantial portion of the water entering the downspout is filtered, it is preferred that the screen have a large enough area to make contact with all four walls 46-49 of the interior of the downspout housing. Alternatively (or, in addition). one or more baffles are mounted within the downspout to divert the flow of water toward the screen. In FIG. 1, two baffles 52 and 54 are shown secured to the front wall 46 and side wall 48, respectively, of the upgraded downspout portion at a position above the downspout opening 60, and oriented such that the baffle projects toward the Coanda screen 20. The side baffle 54 comprises a front plate 58 and a rear plate 59. The rear plate 59 is attached to the side wall 48 by known methods, including welding, adhesive, mechanical fasteners and the like while the front plate 58 protrudes from the side wall 48. The front plate 58 protrusion acts as a diverter to divert water that clings to the side wall towards the screen 20. Similar attachment and configuration is discussed below for a deflector plate (FIG. 2A).

Figure 3:
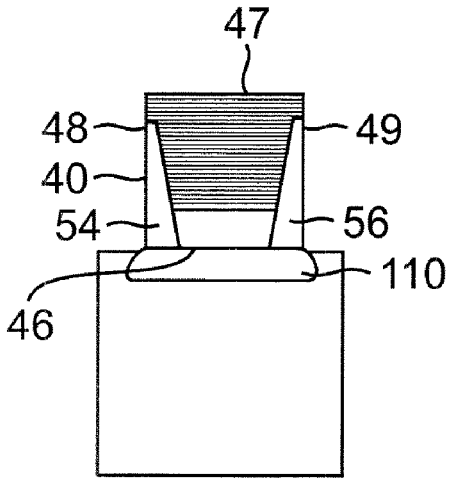
FIG. 3 is a cross-sectional view of the downspout of FIG. 2, taken at line 3-3.
Figure 2:
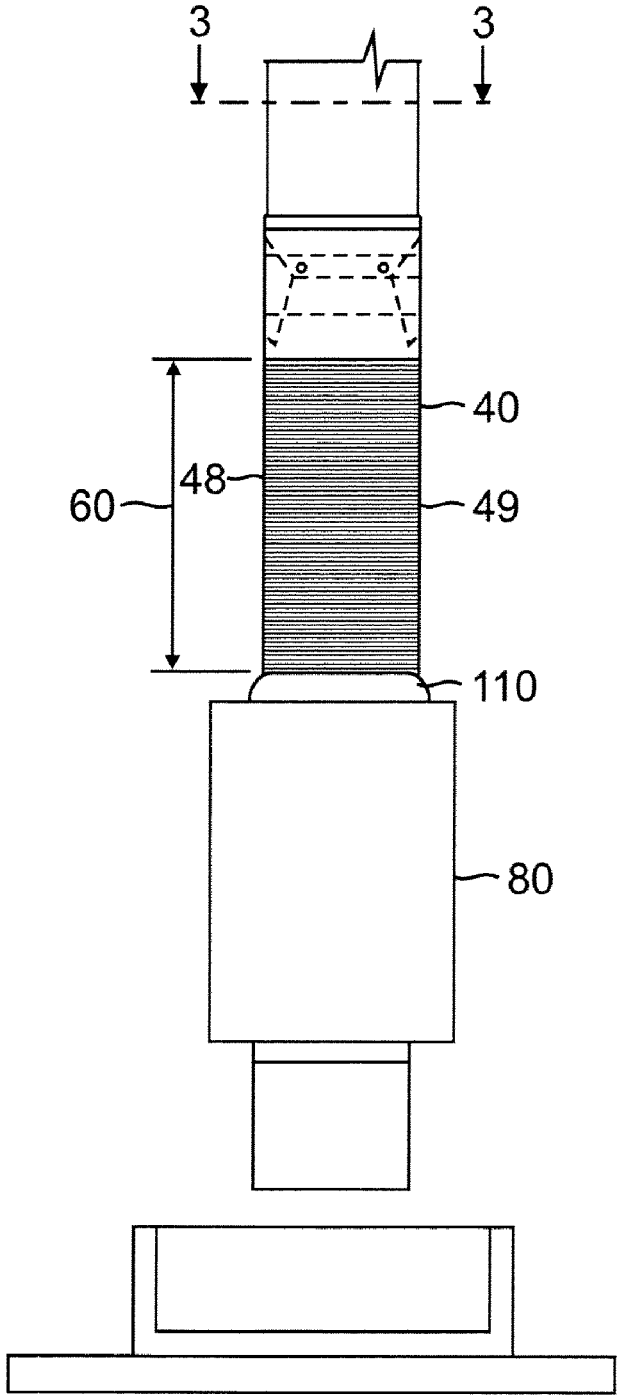
FIG. 2 is a front elevation view of the downspout of FIG. 1.

In FIG. 3, two side baffles 54 and 56 are shown, secured to the left 48 and right 49 side walls of the downspout. Fewer or greater numbers of baffles can be mounted within the downspout to provide optimal diversion of water toward the Coanda screen. For example, the back wall 47 can also be configured to include a baffle. This may be desirable where the upstream end 26 of the screen is not recessed within the surface of the back wall 47. The presence of such a baffle ensures that water cannot bypass the screen. The baffles can be attached to the inside walls of the downspout using any conventional means, including, without limitation, welding, adhesives, and mechanical fasteners.

The downspout opening 60 provides access to the Coanda screen for maintenance and cleaning. Although the screen is self-cleaning, occasionally debris may become trapped within the downspout or (rarely) wedged between the wires 30 that form the screen. Access to the screen is facilitated by providing the downspout opening 60 with appropriate dimensions relative to the screen 20. A preferred downspout opening 60 has a width approximately 50-100% of the interior width of the downspout, and a height approximately 33-75% of the vertical profile of the screen 20, the latter being measured at the wall opposite the downspout opening (the back wall 47 in FIG. 1) The downspout opening 60 is located intermediate the upstream and downstream ends of the downspout 10, but not necessarily equidistant from both ends.

A retaining basket 80 to catch debris caught by the Coanda screen is mounted to the downspout just below a debris deflector plate (further discussed below), using conventional means, such as welding, adhesives, mechanical fasteners, and the like. In an exemplary embodiment, the retaining basket 80 comprises a tightly woven screen made of steel, aluminum, or other weather-resistant material. Debris that does not freely fall into the retaining basket 80 (i.e., debris that clings to the filter due to friction) is eventually pushed out the downspout opening 60 by additional water flowing from the gutter. Water clinging to debris caught in the retaining basket 80 can drip onto the splash guard 100 by passing through the holes of the retaining basket 80. Alternatively, if an underground header is used to connect with the downspout, water that passes through the retaining basket can be caught by a collector (not shown) mounted beneath the retaining basket, and channeled to the header.

In an exemplary embodiment, the downspout is also equipped with an external debris deflector plate 110. The debris deflector plate is mounted just below the downspout opening 60 along the external surface of the front wall 46, just above the retaining basket 80. The debris deflector plate covers any space between the downspout 10 and the retaining basket 80, and ensures that debris exiting the downspout opening does not fall between the downspout and the retaining basket.

In an exemplary embodiment shown in FIG. 2A, the deflector plate 110 includes a front plate section 112 configured to deflect debris into the retaining basket, and a rear plate section 114 configured to be attached to the downspout. In an exemplary embodiment, the deflector plate 110, like the downspout itself, is made of a durable, weather-resistant material, such as aluminum, plastic (e.g., polyvinyl chloride and unplasticized vinyl), galvanized steel, and the like. The deflector plate can be mounted to the downspout by known methods, including welding, adhesives, mechanical fasteners, and so forth.

Figure 4:
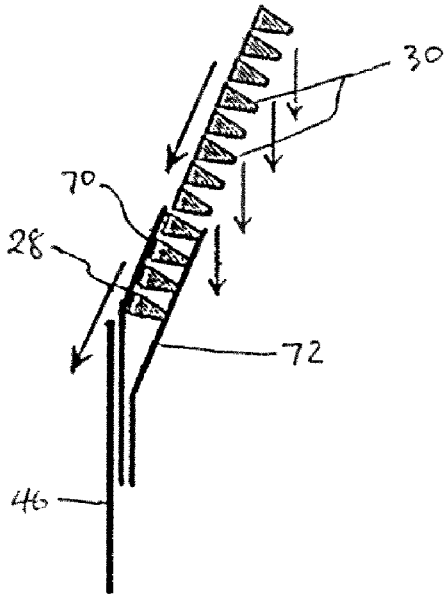
FIG. 4 is an enlarged view of the Coanda screen attached at its downstream end to the downspout.

Reference is now made to FIG. 4, which is an enlarged view of Detail A indicated in FIG. 1. The downstream end 28 of the Coanda screen is shown secured to the downspout front wall 46 by an upper bracket 70 and a lower bracket 72, without obstructing the flow of debris from the upper surface of the Coanda screen into the retaining basket. The two brackets are attached to the downspout by conventional means, such as welding, adhesives, mechanical fasteners, and so forth. Preferably, the upper bracket is substantially flush with the outer wall of the downspout housing at the bottom of the downspout opening.

Figure 5:
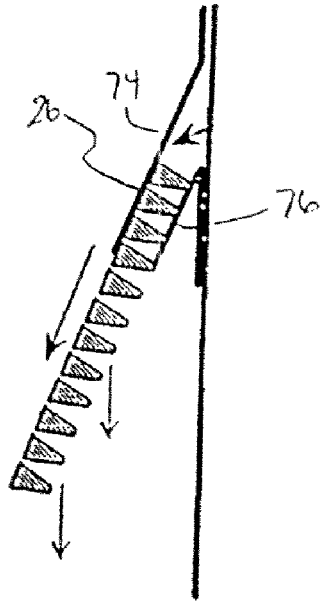
FIG. 5 is another enlarged view of the same Coanda screen attached at its upstream end to the downspout.

Similarly, FIG. 5 provides an enlarged view of Detail B indicated in FIG. 1. The upstream end 26 of the Coanda screen 20 is shown secured to the downspout back wall 47 by upper 74 and lower 76 brackets. However, in addition to securing the upstream end of the screen 20, the upper bracket 74 also serves to divert water flow along the back wall 47 of the downspout to the screen. Although not shown, similar upper brackets may also be mounted around the entire perimeter of the screen so that any water flow along any of the four downspout walls is diverted toward the screen. The two brackets 74, 76 are attached to the downspout by conventional means, such as welding adhesives, mechanical fasteners, and so forth.

Figure 6:
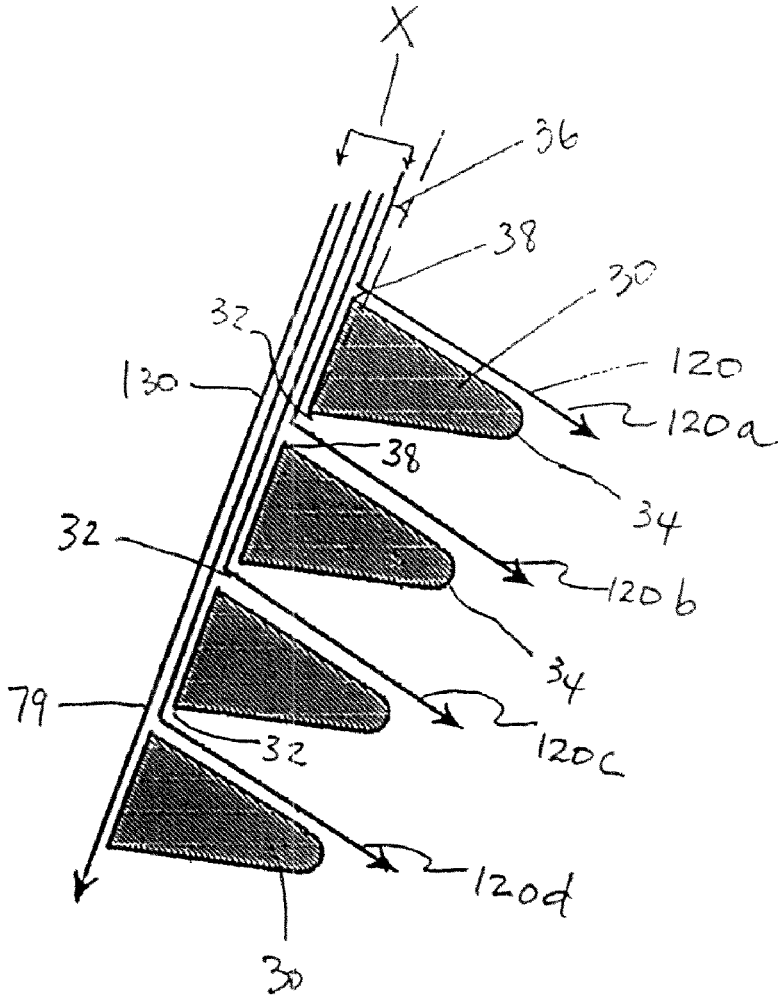
FIG. 6 is an enlarged view of a section of the Coanda screen of FIGS. 4 and 5.
Figure 6A:
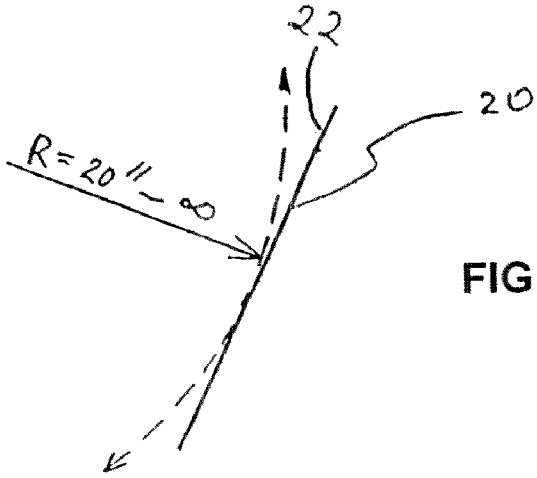
FIG. 6A is a depiction of a concave screen surface.

FIG. 6 shows an exemplary cross-sectional view of the Coanda-effect screen 20. The screen comprises a plurality of individual wedge wires 30 which are parallel to one another and separated from each other by a gap or spacing 32. The individual wedge wires 30 are held together in the indicated arrangement by welding two or more backer rods (not shown) to the base portions 34 of each individual wedge wire 30. Coanda screens are commercially available in several standard sizes. Generally, the difference in screen selection relates the width, height, and tilt angle 36 of the wedge wires, and the gap spacing 32 between the wedge wires. In addition, the Coanda screen may be ordered with an overall concave shape. As shown in FIG. 6A, the term "concave" implies a curved contour when viewed with respect to the upper surface 22 of the screen 20. When a concave screen is specified, the concave shape has the effect of increasing the tilt angle of the individual wedge wires. This in turn allows the leading (upstream) edge 38 of the wedge wire to shear a greater amount of the water, provided that all other parameters are unchanged. In an exemplary embodiment, the Coanda screen has a gap spacing of about 0.1 to 1.0 mm and a tilt angle of about 3 to 15 degrees, with a radius ("R") of concavity of from about 6 inches to infinity (when R=infinity, the screen is flat). Alternatively, other screen parameters may be used, taking into account the size of the debris likely to be encountered, the anticipated water flow rate and volume, and so forth.

Coanda screens are available from a number of manufacturers and retailers, including on-line retailers such as www.hydroscreen.com, www.johnsonscreens.com, and www.eni.com/norris/default.html. The screen is described in an article entitled "Hydraulic Performance of Coanda-Effect Screens" by Tony Wahl for publication in the Journal of Hydraulic Engineering, Vol. 127, No. 6, June 2001, the entire contents of which are expressly incorporated herein by reference as if set forth in full.

As explained by Wahl, the Coanda effect is a tendency of a fluid jet to remain attached to a solid flow boundary. As shown in FIG. 6, when water 130 flows across the screen 20 from the upstream direction, it tends to remain attached to the upper surface of the screen as it travels in the direction of the downgrade 79. At a given point along the screen, the water has a thickness "X". As water 130 flows down the screen, its thickness X is sheared by the leading edge 38 of each individual wedge wire 30. The sheared water is then redirected approximately tangentially 120 to the direction of the original flow due to the contour of the wedge wire 30. Thus, different wedge wire contour will cause water to be redirected differently. This shearing action is repeated as water traverses down the screen along the direction of the downgrade 79. Water is sheared as it travels over other wedge wires 30. After each layer of water is sheared, it is caused to flow along one of several filtered water paths 120*a*, 120*b*, 120*c*, 120*d*, etc. The thickness of the water stream gets progressively smaller as the downstream end of the screen is approached, and the flow of water appears to slow to a mere trickle, or even drop off altogether.

This phenomenon is used to great effect in the present invention. Debris-laden water is effectively filtered at the Coanda screen. Any debris that does not fall into the retaining basket 80 during rainfall eventually dries on the screen, and either falls into the basket later, or can be manually removed via the downspout opening 60.

Figure 7:
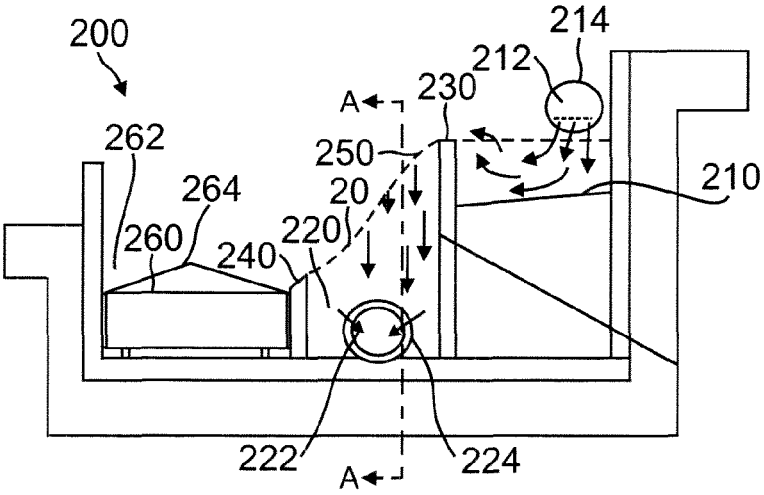
FIG. 7 is a side elevation view of a storm drain system in accordance with practice of the present invention.
Figure 8:
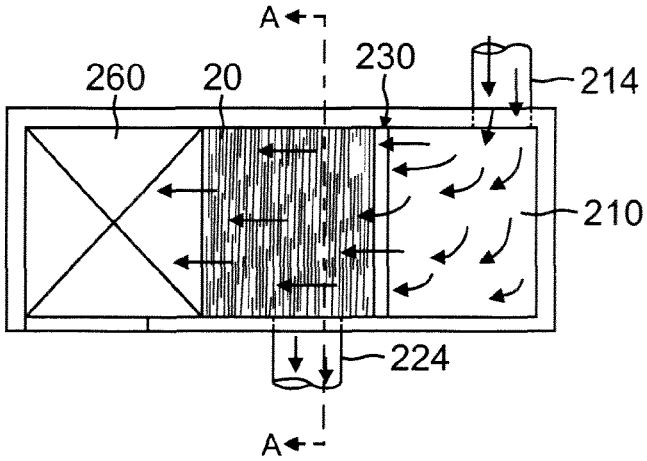
FIG. 8 is a top plan view of the storm drain system of FIG. 7.
Figure 9:
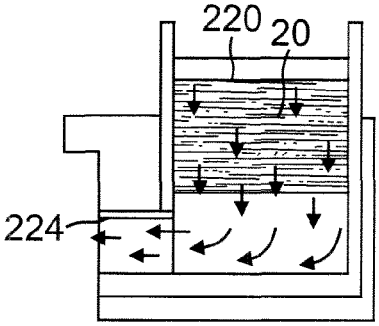
FIG. 9 is a partial cross-sectional view of the storm drain system of FIG. 7 taken at line A-A.

In an alternate embodiment of the invention shown in FIGS. 7-9, an effective filter system for removing debris from a storm water runoff collector is provided. The runoff collector 200 comprises a Coanda screen 20 installed between a raw inlet basin 210 and an outlet basin 220. As before, the screen 20 filters incoming water while trapping debris, but the source of water is a raw stream 212, from an inlet 214, and the effluent is a discharge stream 222 for an outlet line 224.

In an exemplary embodiment, the Coanda screen 20 is mounted between a first weir 230 and a second weir 240. The screen has a concave surface, with a radius of from about 6 inches to infinity, and is outfitted with an acceleration plate 250. The acceleration plate 250 is a metal plate of hardened steel, such as stainless steel and the like, mounted to the upstream end 26 of the screen.

The acceleration plate has a width of approximately 2 inches or higher depending on the size of the storm drain system. When water flows from the raw inlet basin 210 over the weir 230, it has a relatively low flow velocity. If water is allowed to flow over the screen 20 without first having the necessary flow velocity, the screen=s ability to filter out debris will greatly decrease. The acceleration plate provides a vertical drop of about 2 inches or higher, allowing in-coming water to build up velocity before it contacts the first wedge wire on the screen.

Debris caught by the Coanda screen can slide into a retention basket 260 located within a retention basin 262. In an exemplary embodiment, the retention basket 260 is equipped with a handle 264, which allows the retaining basket to be lifted out of the basin, whereupon the debris can be discarded. The basket 260 may be a conventional basket and may be constructed out of medium to large steel wire mesh. Due to its size, it may be necessary to lift the basket with a crane or a flit truck having a lift.

Figure 10:
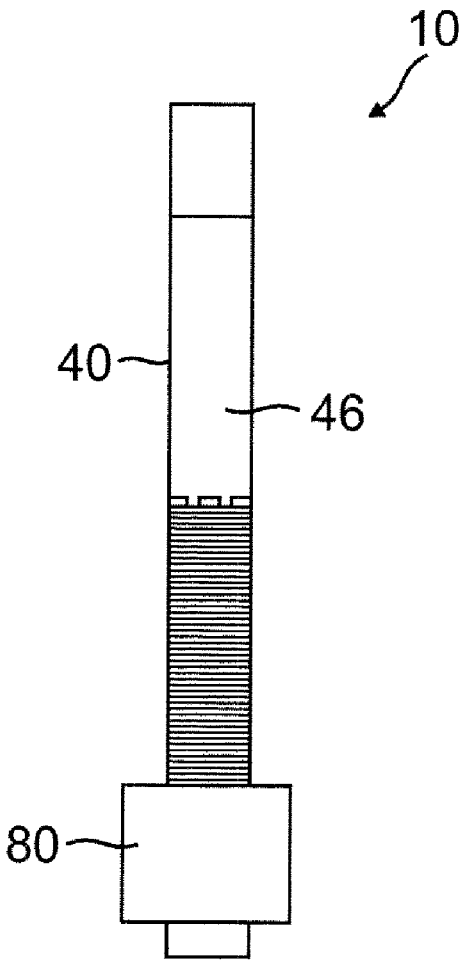
FIG. 10 is a front elevation view of an alternative downspout with a Coanda screen.
Figure 11:
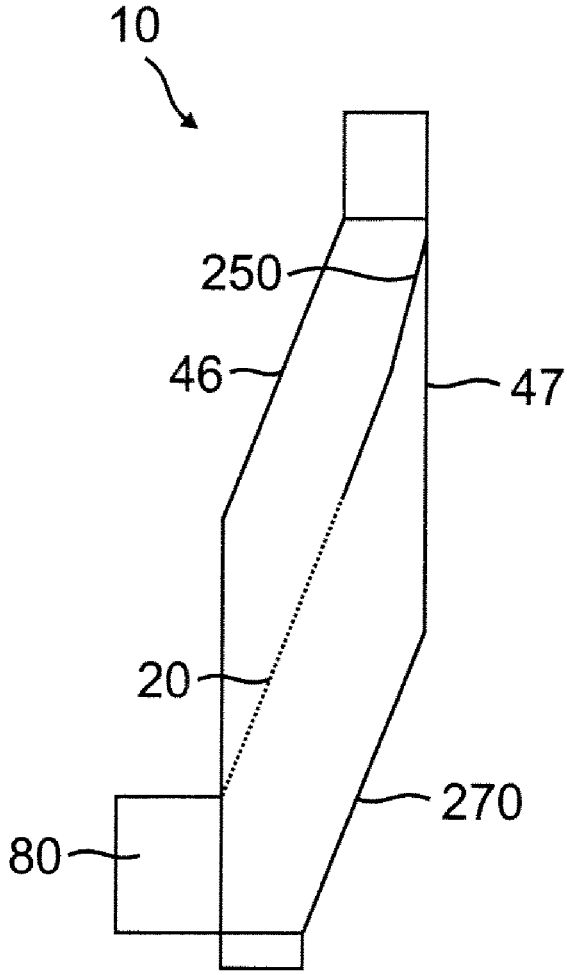
FIG. 11 is a side elevation view of the embodiment of FIG. 10.

In an alternate embodiment of the upgraded downspout 10 shown in FIGS. 10 and 11, a tapered front wall 46 and a modified back wall 47 having a tapered back wall section 270 is provided. The tapered front wall 46 and tapered back wall section 270 allow the screen 20 to be moved forward in the direction of the retaining basket 80, and provide clearance for the installation of an acceleration plate 250. In an exemplary embodiment, additional wall mounted baffles for diverting water toward the screen 20 are not necessary, as the screen is positioned directly below the incoming flow path and even extends past the incoming path. This screen configuration allows all or substantially all of the incoming flow to flow through the screen.

Figures 12, 13:
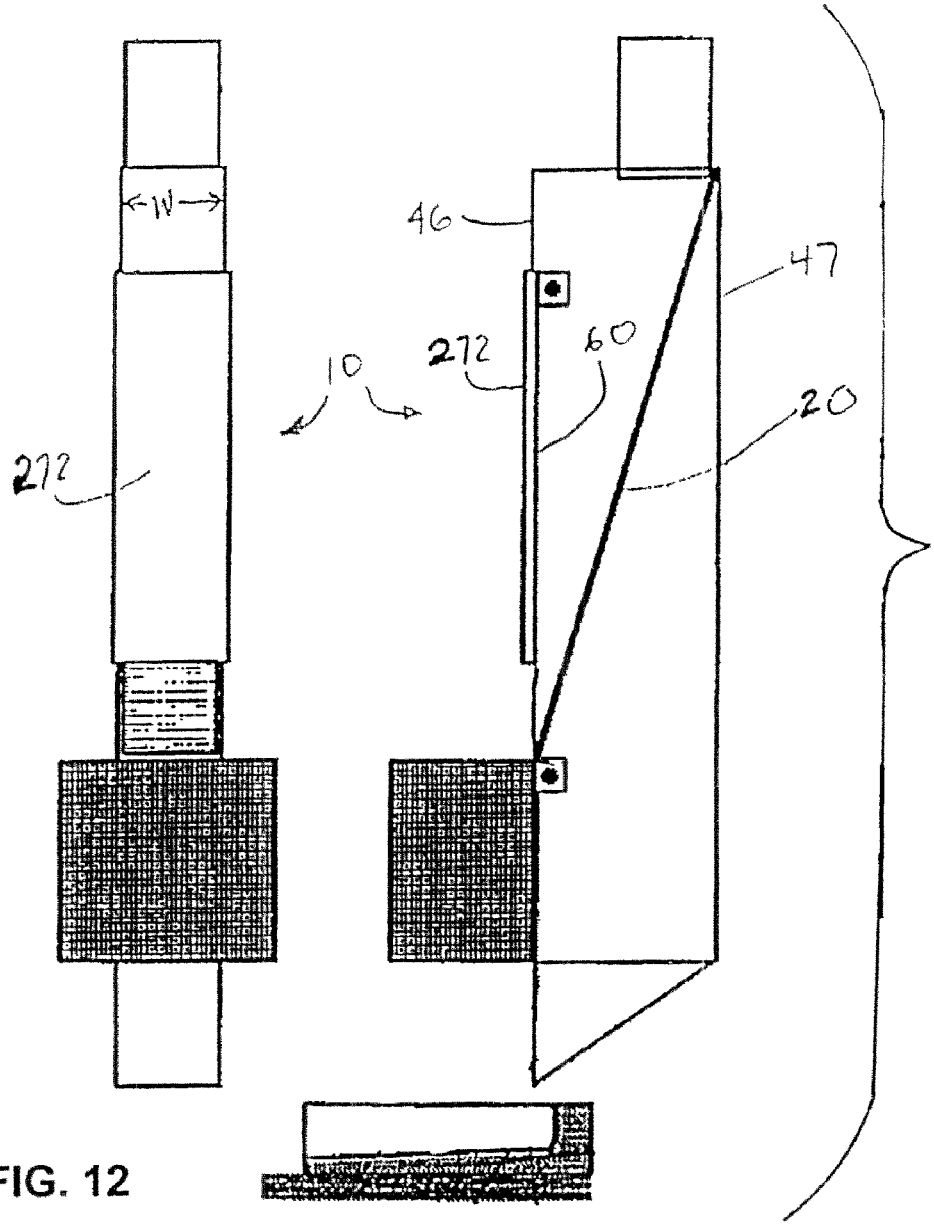
FIG. 12 is a front elevation view of another alternative downspout embodiment with a Coanda screen.
FIG. 13 is a side elevation view of the embodiment of FIG. 12.

In another alternate embodiment of the upgraded downspout 10, shown in FIGS. 12 and 13, an optional hinged cover 272 is provided over the downspout opening 60 of an enlarged upgraded downspout 10. The enlarged upgraded downspout 10 is slightly larger than a conventional or existing downspout section. but has a much larger depth (the distance between the front wall 46 and the back wall 47), e.g., on the order of about 1.3 to 3 times deeper. This allows the enlarged upgraded downspout to accommodate a much larger screen 20 than a standard size upgraded downspout. This in turn, allows the much larger screen 20 to filter substantially all of the incoming flow without the need for wall mounted baffles. However, in the embodiment of FIGS. 10-13, wall mounted baffles, such as baffles 52 and 54, can be used.

Figure 14:
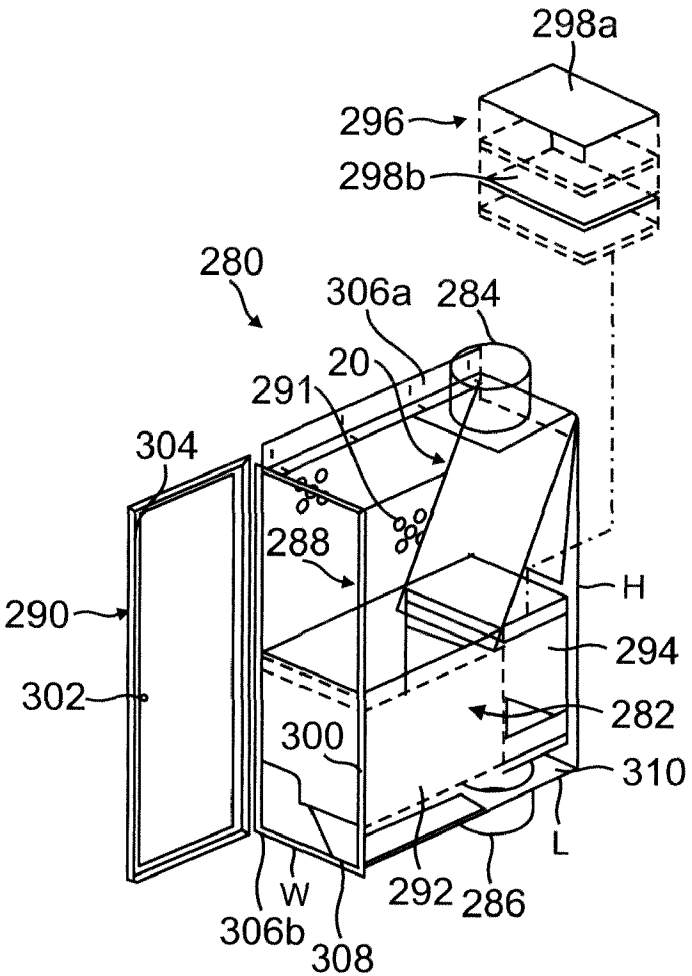
FIG. 14 is a semi-schematic partial transparent, exploded, and perspective view of an alternative downspout filter assembly provided in accordance with aspects of the present invention comprising a plurality media pads for scrubbing filtered water.

Referring now to FIG. 14, a semi-schematic partial perspective-partial transparent view of an alternative downspout filter assembly 280 provided in accordance with aspects of the present invention is shown. In one exemplary embodiment, the downspout filter assembly 280 comprises a housing 282, having a downspout inlet 284, a downspout outlet 286, an interior cavity 288 comprising a plurality of filter components, and an optional door cover 290. The filter assembly 280 is configured for use in a section of a downspout installed on a structure, such as a parking structure, a building, or other structures that require a water gutter system. As readily apparent, a section of a downspout is to be replaced by the downspout filter assembly 280. When replaced, an upper or upstream section of the downspout is to be coupled to the downspout inlet 284 by conventional means and a lower or downstream section of the downspout is to be coupled to the downspout outlet 286 also by conventional means. Alternatively. the downspout outlet 286 may be coupled directly to a drain or remain opened to drain over a surface drain. The filter assembly 280 is adaptable in that it may be installed in an existing downspout section or be part of a new downspout installation.

In one exemplary embodiment, the filter components comprise a Coanda filter 20, a collection container or a debris container 292, an outlet container 294, and a filter medium 296, which may comprise one or more media pads 298*a*, 298*b* for one or more different filtering functions. Alternatively, a filter comprising a plurality of wedge wires may be used to filter debris and other contaminants, with tilted wedge wires or Coanda screen being more preferred. Screen pith wedge wires are commercially available, for example, through Goel Engineers in India, which has the following website: http://www.goelka.com/wws.htm. The filter components are housed inside the interior cavity 288 of the housing 282 and are closed therein by a door cover 290 abutting the housing flange 300 and a latch 302, which may embody a key lock or other prior art means for securing the door to the flange. In one exemplary embodiment, the door cover 290 may comprise two or more door sections and may include a gasket 304 for providing a relatively tight seal as compared to when no gasket is used. The gasket may include any prior art gaskets and may adhere to the door cover by adhesive. The door cover 290 is connected to the housing 282 via one or more conventional hinges or fasteners. For venting, one or more vent holes 291 may be incorporated on one or more sides of the housing 282. If the vent holes 291 are incorporated, they are preferably positioned at a location with minimal water splash.

The housing 282 may comprise a number of different shaped configuration, such as a rectangular shaped box, a square shaped box, or a cylindrical shaped box, with a rectangular shaped box being more preferred. The housing 282 may be made from a number of metallic sheets, such as stainless steel sheets, tin sheets, sheet metal, and zinc coated sheet metal with stainless steel sheets being more preferred. Alternatively, plastic, fiberglass, or synthetic plastic materials may be used.

Figure 16:
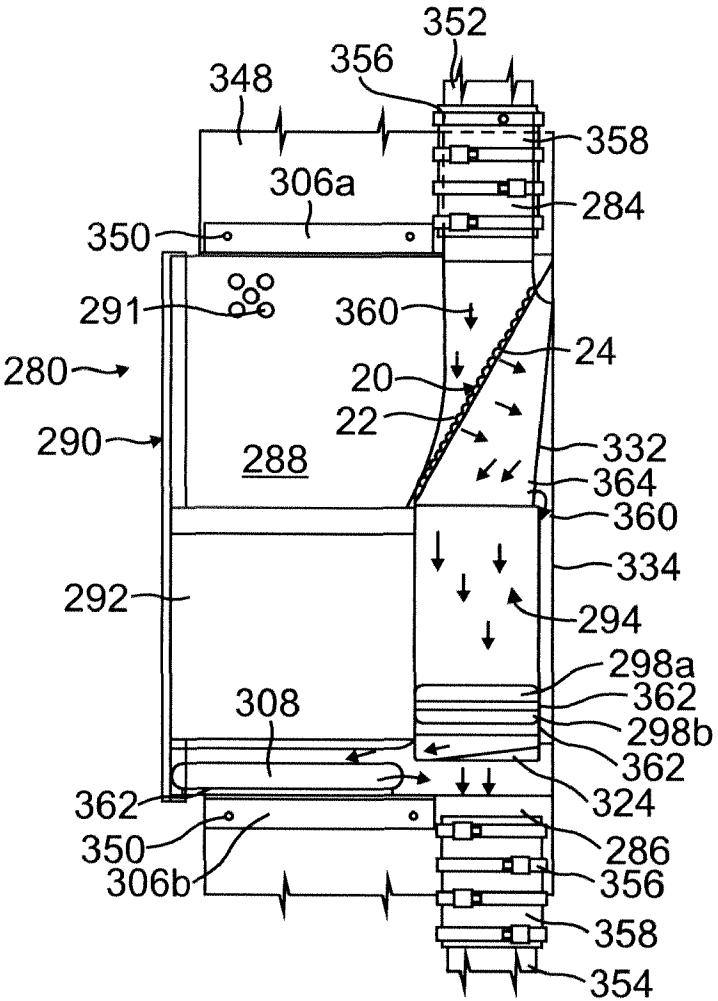
FIG. 16 is a semi-schematic side view and partial cross-sectional view of the alternative downspout filter assembly of FIG. 14 mounted on a structure and assembled to an upper and a lower downspout section.

Referring to the referenced length L, height H, and width W of the housing 282, in a preferred embodiment, the filter assembly 280 is mounted along a lengthwise direction L against a structure 348 (FIG. 16). To facilitate attachment along the lengthwise direction L, the housing 282 includes a pair of mounting flanges 306*a,* 306*b,* one along the upper housing section and one along the lower housing section. Alternatively, the filter assembly 280 may be mounted along the width direction W by incorporating the two mounting flanges 306*a,* 306*b* along the width edge of the upper and lower sections of the housing 282.

Also shown in FIG. 14 is an optional final treatment filter media 308. The final filter media 308, when incorporated, is to be positioned in a sump 310, which is the space defined by the area under the two containers 292,294 and the bottom of the housing 282. The media pads 298*a,* 298*b* and the final filter media 308, when incorporated, are configured to remove organic compounds, toxic metals, particulates, and other undesirable contaminants. The various filter medium may comprise, for examples, e.g., activated carbon, Rubberizer® polymers and particulate products, metal absorbing soy bean hulls, peat, siliceous rocks, activated silica, Miex resins, and potassium permanganate pellets. Depending on the contaminants to be removed, the particular media to be used can be selected accordingly. As an alternative or in addition to the absorbent pads, pelletized hypochlorite or other formulations of chlorine may be used as a media to kill undesirable bacteria, such as *E-coli* bacteria. Still alternatively, where electricity power is available, the housing may be equipped with UV (ultraviolet) lamps to provide ultraviolet radiation to also kill undesirable bacteria. Conventional mounting means for mounting UV lamps in a wet environment would be required if UV lamps are incorporated.

Broadly speaking regarding operation of the downspout filter assembly 280, during a rain storm or cleaning operation in which water is used, water is directed down a downspout, flows through the downspout inlet 284, is filtered by the Coanda filter 20, in which solids and other suspended contaminants are filtered by the filter 20 and are trapped along the upper surface of the filter and the passes through to the outlet container 294. The trapped solids and other suspended contaminants are subsequently collected in the collection container 292, either by being pushed into the container 292 by later trapped solids, gravity, or by a service technician. The filtered water that passes through the filter 20 is additionally filtered by the filter medium 296 positioned in the outlet container 294 and by the final filter media 308 located in the sump 310, if incorporated. Water then flows out the filter assembly 280 via the downspout outlet 286.

Figure 15:
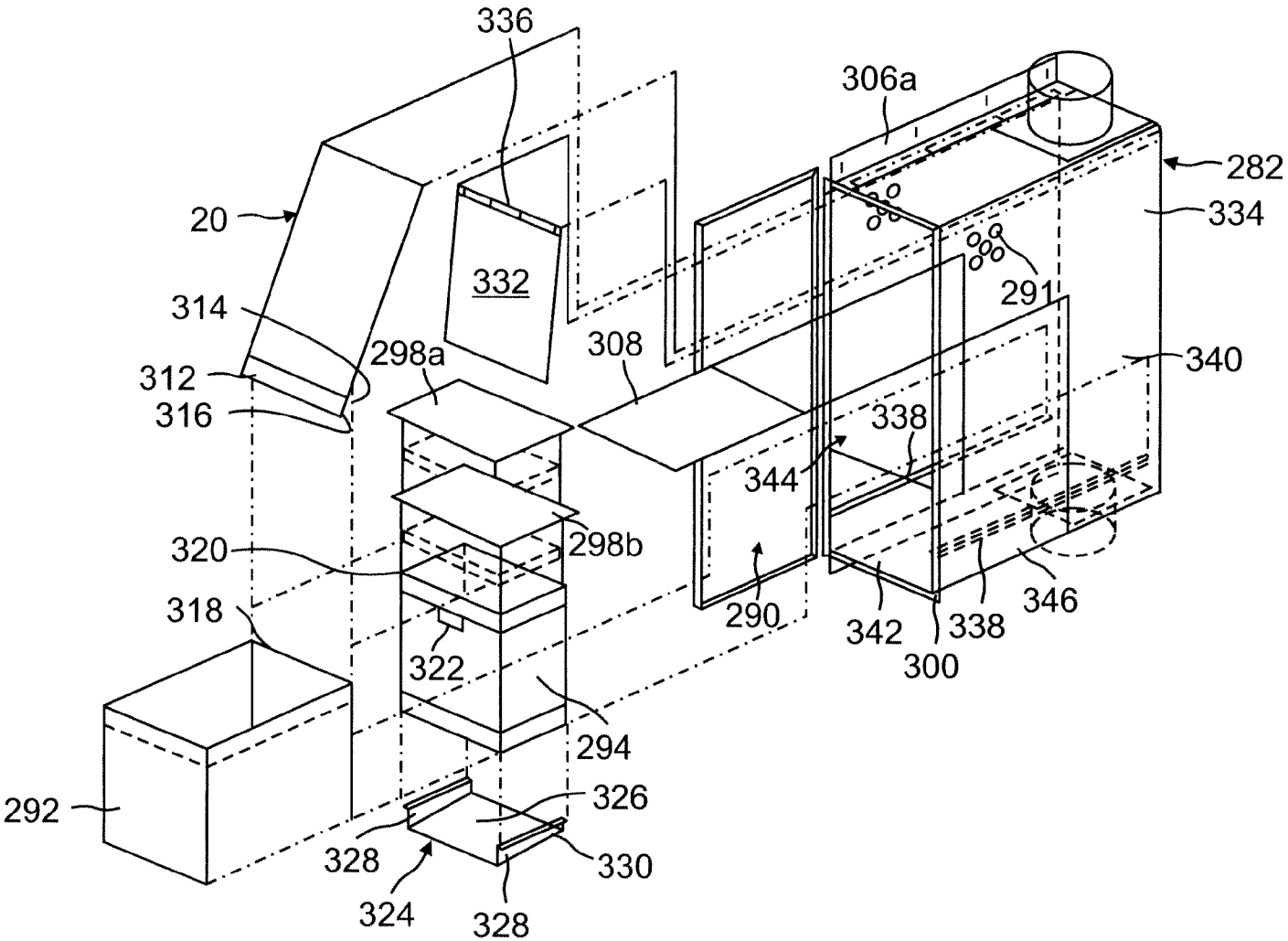
FIG. 15 is a semi-schematic partial transparent, exploded, and perspective view of the alternative downspout filter assembly of FIG. 14.

Referring now to FIG. 15 in addition to FIG. 14, an exploded perspective view of the downspout filter assembly 280 provided in accordance with aspects of the present invention is shown. The filter 20 incorporated herein is similar to the filter described above with reference to FIGS. 1-6A, and, in addition, may include both wedge wires and tilted wedge wires. A baffle or plate 312, which may embody a rectangular metallic or plastic plate, is connected to the lower edge of the filter 20 with a second plate 314 connected to the filter 20 at its underside to form an inverted "V" shaped ledge 316. When assembled, the ledge 316 is adapted to receive or rest on the support rim 318 of the collection container 292 and the support rim 320 of the outlet container 294 (See, e.g., FIG. 14) while the upper filter section rests against the back wall of the housing 292. Optionally, latching mechanisms may be used to removably fasten the filter inside the housing using conventional fastening means.

The containers 292, 294 incorporated herein may be made of a metallic mesh material for durability, such as a stainless steel mesh material. However, rubber or hard plastic containers may also be incorporated where desired. In one exemplary embodiment, the mesh size for the collection container 292 should be smaller than the mesh size for the outlet container 294 to prevent or minimize small solids collected in the collection container 292 from escaping through the plurality of openings provided by the mesh. Obviously, the mesh size for both containers can be similarly sized for ease of manufacturability. Handles 322 may be added to the containers 292, 294 for ease of handling the containers during cleaning or other maintenance operation when the containers are removed from the interior cavity 288.

The outlet container 294 and the media pads 298*a,* 298*b* should be sized such that the perimeter of the pads contacts the interior surface of the outlet container 294 when the media pads 298*a,* 298*b* are placed therein (FIG. 16). As readily apparent, this configuration ensures that water entering the outlet container 294 will pass through the media pads 298*a,* 298*b* before it exists the downspout outlet 286. The pads 298*a,* 298*b* are positioned in the outlet container by stacking and resting them directly on the base of the container 294. Optionally, a treatment pad separator (not shown) may be placed in the container first before the first media pad is added with additional treatment pads to be placed in between a set of media pads. The overall dimensions of the containers 292, 294, media pads 298*a,* 298*b,* and other components of the filter assembly 280 can vary depending on the volume throughput of the particular downspout, which can vary from installation to installation. In a preferred embodiment, the filter assembly 280 and all its components should be sized to handle about 110% to about 125% of the maximum expected flow rate of the particular downspout section.

In one exemplary embodiment, an exit flow deflector 324 comprising a base 326 and two side walls 328 each comprising a rail or a flange 330 are incorporated in the filter assembly 280. The base 326 preferably has a surface that is sloped about 10-30 degrees from the surface of the flanges 330 for directing flow entering the sump area 310, as further discussed below. The flow deflector 324 should have a length and a width approximately that of the outlet container 294. The flow deflector 324 is preferably made from a rigid material, such as a sufficiently gauged metallic sheet or a hard plastic.

In an exemplary embodiment, a main baffle or deflector plate 332 may be incorporated in the filter assembly 280. As further discussed below, the main baffle 332, if desired, may be installed subjacent or behind the filter 20 so that as water passes through the filter 20, it is deflected away from the back side wall 334 of the housing 282 by the main baffle. As readily apparent, this arrangement allows the baffle to direct water away from the housing wall so that the water can then flow through the outlet container 294 where it could be scrubbed or cleaned by the media pads 298*a,* 298*b,* When installed, the surface of the main baffle 332 should be angled about 5-30 degrees relative to the back sidewall 334. Rivets, spot welding, brackets, fasteners, or other conventional attachment means may be used to attach the flange section 336 of the main baffle 332 to the back sidewall 334.

Two brackets or rails 338, one on an outside sidewall 340 and one on an inside sidewall 342, are incorporated for placement of the exit flow deflector 324 and the two containers 292, 294 thereon. The rails 338, which resemble right-angle brackets, provide two ledges that protrude from the two sidewalls 340, 342. The ledges are configured to support the deflector 324 and the two containers 292, 294 when the same are placed thereon. More particularly, the rails 338 support the deflector 324 and the two containers 292, 294 by first placing the two flanges 330 of the deflector 324 on the rails 338 and then placing the containers 292, 294 over the rails, with the outlet container 294 preferably placed directly over the deflector 324 (See. e.g., FIG. 1). The sump 310 is an area defined in part by the base of the containers 292, 294 when over the same are placed on the rails 338.

A containment dam 342 is positioned at the entrance 344 to the interior cavity 288 of the housing 282. The containment dam 342 preferably contacts and forms a seal with the two side walls 340, 342 and the base wall 346 of the housing. The containment dam 342 preferably extends about ⅕ to about ⅓ of the height of the entrance 344, and should at least be level with or rises above the surface of the rails 338. The containment dam 342 may be attached to the housing using any prior art methods, including forming the dam by bending a portion of one or more of the sidewalls and then using welding or epoxy to seal the seam.

Referring now to FIG. 16 in addition to FIGS. 14 and 15, a semi-schematic side view and partial cross-sectional view of the downspout filter assembly 280 is shown mounted on a structure 348. As previously discussed, the filter assembly 280 may be mounted by fastening the upper and lower mounting flanges 306*a*, 306*b* to the structure using a plurality of fasteners 350. The inlet 284 and outlet 286 are strapped or clamped to the upper downspout section 352 and lower downspout section 354, respectively, using fastening clamps or straps 356 in combination with pliant wrappers 358. The pliant wrappers can embody rubber sheets or other equivalent materials. However, any prior art coupling means may optionally be used to couple the inlet and outlet of the system 280 to the upper and lower downspout sections.

As shown when water 360 enters the downspout assembly 280 via the inlet 284 and into the interior cavity 288, the water makes contact with the filter 20. As previously discussed, debris and other solids carried by the water 360 are then trapped by the filter 20 along the upper surface 22 of the filter. The solids and the debris are then pushed by the stream of incoming water and incoming solids, and/or by gravity, and fall into the collection container 292. Water, however, passes through the filter 20 to the underside 24 of the filter in the direction of the main deflector plate 332. During normal flow, water flows in a downward direction towards the outlet container 294, where it is then cleaned or scrubbed by the media pads 298*a*, 298*b* before being deflected again by the exit flow deflector 324. The exit flow deflector 324 channels the water over the final filter media 308 where it is further cleaned or scrubbed before existing the housing 292 via the outlet 286.

As readily apparent, the media pads 298*a*, 298*b*, 308 may be eliminated, replaced with other media pads, or used in combination with additional media pads depending on the desired outcome and/or on environmental regulations. When media pads are used, treatment pad separators 362 may be used to separate the media pad from an adjacent pad or from a solid surface, such as the bottom of the housing. The separators 362 may be made from nylon or plastic webbing sheets such as spun-bonded webbing sheets, steel mesh, porous media, or other material to provide gaps or passages for the water flow.

In an exemplary embodiment, a passage 364 is provided internally of the interior cavity 288 for bypassing water 360 around the media pads 298*a*, 298 positioned inside the outlet container 294. This passage 364 is located intermediate the lower edge of the main deflector 332 and the top of the outlet container 294 proximate the back sidewall 334 of the housing 292. In the event the media pads 298*a*, 298*b* are clogged and water backs up in the outlet container 294, water can escape through the passage 364 to then flow out of the housing 292 via the outlet 286.

Although the invention has been described with reference to preferred and exemplary embodiments, various modifications can be made without departing from the scope of the invention, and all such changes and modifications are intended to be encompassed by the appended claims. For example, an upgraded downspout section can be manufactured as a separate unit and installed as a new downspout. Other materials than those described herein can be used to make the various components of the apparatus described. Changes to the way the baffles are installed, the way they are shaped, the way the deflector plates are installed, and the way the screens are installed within the housing can be made. Other alterations and modifications may be made by those having ordinary skill in the art, without deviating from the true scope of the invention.

What is claimed is:

1. A downspout filter assembly comprising:

a housing comprising an inlet, and outlet, an interior cavity, and an entrance to the interior cavity;

a filter having a portion positioned subjacent the inlet and comprising a plurality of spaced apart wires mounted at an angle in the interior cavity of the housing, each wire having a wedge shape cross-section and having a planar surface and wherein one planar surface is positioned higher than the planar surface of an adjacent wire; and at least one media pad positioned subjacent the filter for scrubbing water before it exits the outlet, and wherein the plurality of wedge wires are parallel to one another.

2. The downspout filter assembly as recited in claim 1, wherein the plurality of wedge wires comprise a Coanda screen.

3. The downspout filter assembly as recited in claim 1, further comprising a pair of rails fixedly secured to two interior surfaces of the interior cavity.

4. The downspout filter assembly as recited in claim 3, further comprising a pair of basket containers.

5. The downspout filter assembly as recited in claim 4, further comprising a final filter media positioned subjacent at least one of the basket containers.

6. The downspout filter assembly as recited in claim 1, further comprising at least one mounting flange for mounting the housing to a structure.

7. The downspout filter assembly as recited in claim 1, further comprising a second media pad, which is positioned either superjacent or subjacent the at least one media pad.

8. A downspout filter assembly comprising:

a housing comprising an inlet, and outlet, an interior cavity, and at least one surface positioned along a first plane;

a Coanda filter positioned subjacent the inlet, the Coanda filter comprising a plurality of spaced apart wires and having a generally planar surface with a first end and a second end, wherein each of the plurality of spaced apart wires comprises a wedge shape cross- section and having a planar surface and wherein the generally planar surface of the Coanda filter is at an angle to the first plane and the first end is higher than the second end;

at least one media pad positioned in the interior cavity at a position below the Coanda filter, and wherein the plurality of wires have a same orientation relative to a longitudinal center line.

9. The downspout filter assembly as recited in claim 8, further comprising a container located subjacent the second end and spaced radially of the Coanda filter for collecting debris falling off a top surface of the Coanda filter.

10. The downspout filter assembly as recited in claim 8, wherein each wedge wire is spaced apart from an adjacent wedge wire by a first gap along the planar surface and a second larger gap below the planar surface.

11. The downspout filter assembly as recited in claim 8, wherein the media pad comprises a medium comprising at least one of activated carbon, polymers having absorbability for hydrocarbon products, metal absorbing soy bean hulls, peats, siliceous rocks, activated silica, resins having absorbability for dissolved organic matters, potassium permanganate pellets, and pelletized hypochlorite.

12. The downspout filter assembly as recited in claim 8, wherein the housing comprises an unobstructed opening during use.

13. The downspout filter assembly as recited in claim 8, further comprising a container attached to an exterior surface of the housing, below an entrance to the Coanda filter.

14. A downspout filter assembly comprising:

a housing comprising an inlet, an outlet, and an interior cavity;

a pair of rails attached to two sections of the interior cavity;

at least one removable container;

a media pad positioned in the at least one removable container or below the at least one removable container; and a filter comprising a plurality of wires mounted at an angle in the interior cavity in a position subjacent the inlet and above the media pad, the filter having a general planar surface with a first end and a second end, wherein each of the plurality of wires having a wedge shape cross-section and having a planar surface, and wherein one planar surface is positioned higher than the planar surface of an adjacent wire and the first end of the filter is positioned higher than the second end; and wherein the plurality of wires have a same orientation relative to a longitudinal center line.

15. The downspout filter assembly as recited in claim 14, further comprising an entrance to the interior cavity and a container attached to an exterior surface of the housing adjacent the entrance.

16. The downspout filter assembly as recited in claim 15, wherein the container has a solid base.

17. The downspout filter assembly as recited in claim 14, wherein the filter is without sidewalls.

* * * * *

UNITED STATES PATENT AND TRADEMARK OFFICE

CERTIFICATE OF CORRECTION

PATENT NO. : 7,805,890 B2
APPLICATION NO. : 12/399306
DATED : October 5, 2010
INVENTOR(S) : Steven E. Esmond et al.

It is certified that error appears in the above-identified patent and that said Letters Patent is hereby corrected as shown below:

In column 1, line 25, delete “cam” and insert -- can --, therefor.

In column 1, line 40, delete “4,345,925” and insert -- 4,435,925 --, therefor.

In column 3, line 63, delete “etc.).” and insert -- etc.), --, therefor.

In column 4, line 55, after “by” insert -- , --.

In column 4, line 67, delete “addition).” and insert -- addition), --, therefor.

In column 6, line 34, after “welding” insert -- , --.

In column 6, line 38, after “30” insert -- , --.

In column 11, line 45, after “shown” insert -- , --.

In column 13, line 1, in claim 8, delete “cross- section” and insert -- cross-section --, therefor.

Signed and Sealed this
First Day of February, 2011

David J. Kappos

David J. Kappos
*Director of the United States Patent and Trademark Office*